US009692155B2

(12) United States Patent
Toscani et al.

(10) Patent No.: US 9,692,155 B2
(45) Date of Patent: Jun. 27, 2017

(54) JUMPER CLAMPS

(71) Applicants: Gerard M Toscani, Moorestown, NJ (US); Henry J. Mack, Jr., Phillipsburg, NJ (US); Oliver Sha, West Islip, NY (US)

(72) Inventors: Gerard M Toscani, Moorestown, NJ (US); Henry J. Mack, Jr., Phillipsburg, NJ (US); Oliver Sha, West Islip, NY (US)

(73) Assignee: Paris Business Products, Inc., Westampton, NJ (US)

( * ) Notice: Subject to any disclaimer, the term of this patent is extended or adjusted under 35 U.S.C. 154(b) by 0 days.

(21) Appl. No.: 15/215,810

(22) Filed: Jul. 21, 2016

(65) Prior Publication Data

US 2017/0054232 A1 Feb. 23, 2017

Related U.S. Application Data

(60) Provisional application No. 62/206,532, filed on Aug. 18, 2015.

(51) Int. Cl.
*H01R 11/24* (2006.01)

(52) U.S. Cl.
CPC ..... *H01R 11/24* (2013.01)

(58) Field of Classification Search
USPC ..... 439/504, 506, 822, 759
See application file for complete search history.

(56) References Cited

U.S. PATENT DOCUMENTS

| | | | | | |
|---|---|---|---|---|---|
| 3,267,452 | A * | 8/1966 | Wolf | G01R 19/14 | 320/DIG. 20 |
| 4,826,457 | A * | 5/1989 | Varatta | H01R 11/24 | 439/504 |
| 5,021,008 | A * | 6/1991 | Scherer | H01R 11/24 | 439/504 |
| 5,573,426 | A * | 11/1996 | Grant | H01R 11/24 | 439/504 |
| 5,601,452 | A * | 2/1997 | Ruffa | H01R 11/24 | 439/504 |
| 5,618,210 | A * | 4/1997 | Grant | H01R 11/24 | 24/505 |
| 5,772,468 | A * | 6/1998 | Kowalski | H01R 11/24 | 439/506 |
| 6,238,253 | B1 * | 5/2001 | Qualls | H01R 11/24 | 439/759 |
| 6,871,387 | B2 * | 3/2005 | Cheng | H01R 11/24 | 24/499 |
| 6,994,599 | B2 * | 2/2006 | Shurdan | H01R 11/24 | 439/759 |
| 8,083,555 | B2 * | 12/2011 | Schouten | H01R 11/24 | 439/822 |

(Continued)

*Primary Examiner* — Alexander Gilman
(74) *Attorney, Agent, or Firm* — Stuart M. Goldstein

(57) ABSTRACT

A dual conductive electrical jumper clamp system has two jumper clamps, each jumper clamp having upper and lower clamp frames and an electrical conductive contact plate positioned within each frame. An electrical conductive sleeve is positioned between the contact plates. In this manner, electricity is transmitted from an electric power source to only one of the contact plates, then solely to the other contact plate via the conductive sleeve, and ultimately to electrical terminal attaching jaw members at the ends of the contact plates.

16 Claims, 4 Drawing Sheets

(56) References Cited

U.S. PATENT DOCUMENTS 8,342,892 B2 * 1/2013 Fan ..... H01R 11/24
439/822
D738,825 S * 9/2015 Nook ..... D13/120

* cited by examiner

JUMPER CLAMPS

RELATED APPLICATION

This application claims the benefit of Application Ser. No. 62/206532, filed on Aug. 18, 2015.

BACKGROUND OF THE INVENTION

Jumper clamps, with their connecting electrical cables, are well known for use in charging low or dead batteries or other electrical devices which require a charge from a live electrical power source. Such jumper clamps routinely consist of interlocking jaw members configured to attach to the positive and negative electrical terminals of batteries and the like. Once connected to the terminals, electricity from the single power source is delivered to one of the jaw members of each clamp, which then transmits the electricity, through the terminals, to jump the battery.

Often times, however, the jumping process fails because it is unable to conduct sufficient electricity. This may be due to the failure of the jumper clamps to deliver adequate electrical power, since prior clamps have excessive resistance to current flow.

SUMMARY OF THE INVENTION

It is thus the object of the present invention to provide jumper clamps in a jumper clamp system that overcomes the limitations and disadvantages of prior jumper clamps and their systems. This object is accomplished by providing jumper clamps that receive electricity from a single electrical power source and effectively and efficiently deliver, to the battery or other device, twice the electricity through each jumper clamp than the electricity transmitted by prior jumper clamps, by cutting current flow resistance in half.

This and other objects of the present invention are accomplished by a dual, conductive, electrical jumper clamp system, each jumper clamp in the system having upper and lower clamp frames and an electrical conductive contact plate positioned within each frame. An electrical conductive sleeve is positioned between the contact plates. In this manner, electricity is transmitted from an electric power source to only one of the contact plates, then solely to the other contact plate via the conductive sleeve, and ultimately to electrical terminal attaching jaw members at the ends of the contact plates.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
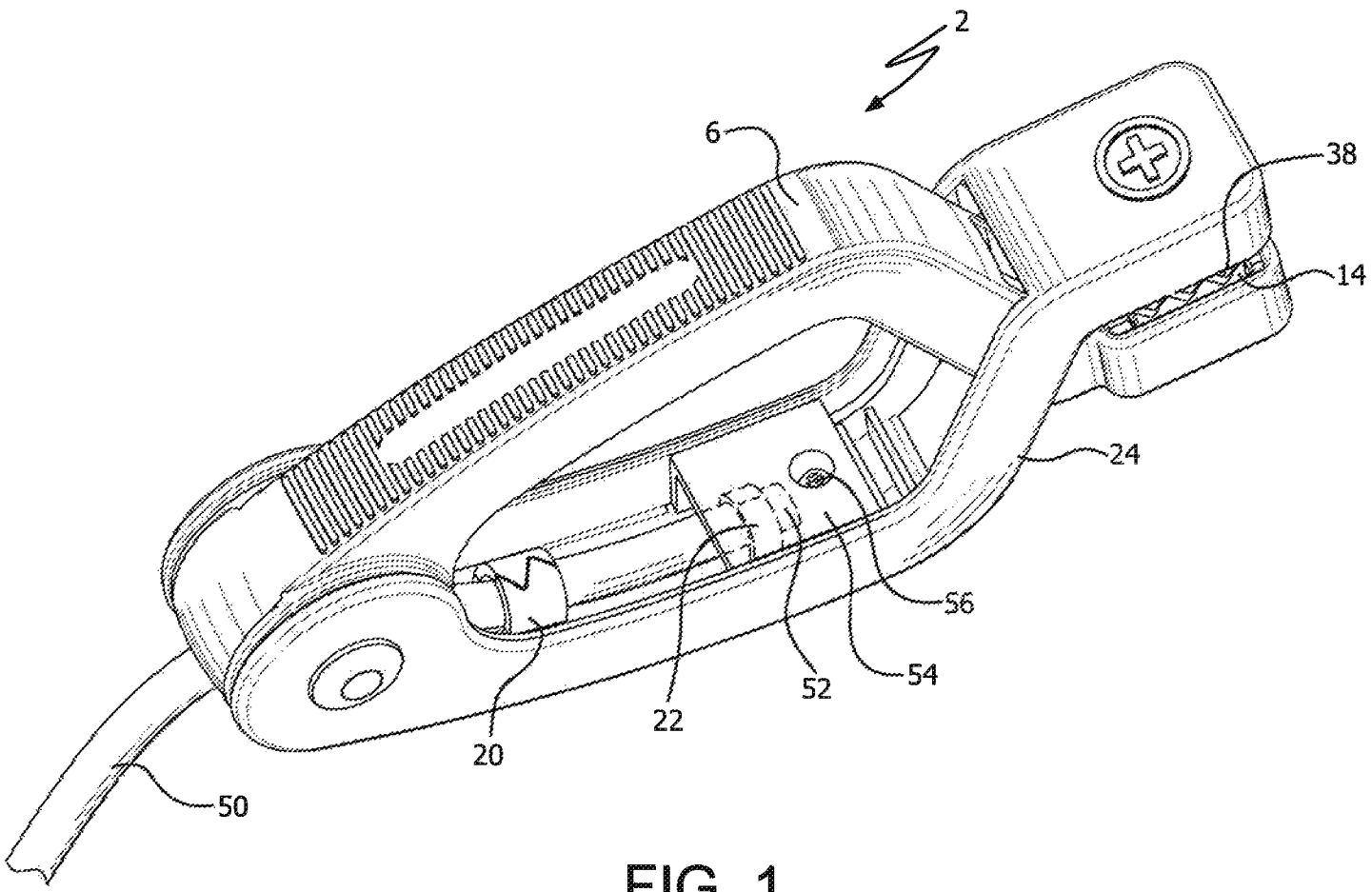
FIG. 1 is a perspective view of one of the jumper clamps of the present invention.
Figure 2:
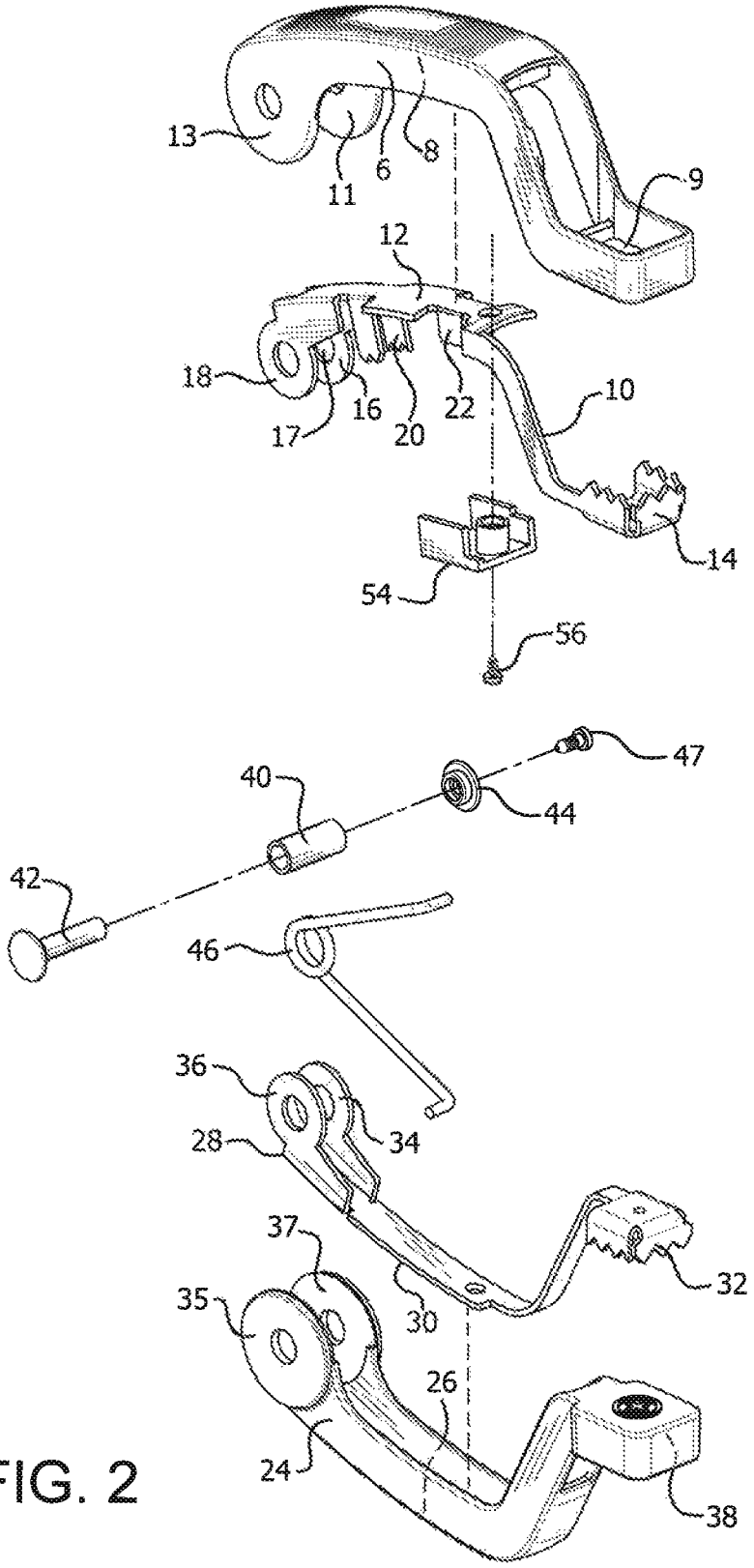
FIG. 2 is an exploded view of the components of a jumper clamp of the present invention.

The jumper clamp system of the invention comprises jumper clamps 2 and 4. The clamps are identical, except that clamp 2 is identified as the clamp for use on battery 80 or other electrically rechargeable device having positive electrical terminal 60 and clamp 4 is identified for use on negative electrical terminal 70. Thus, the description and operation of clamp 2 which follows is thus applicable to substantially identical clamp 4 as well.

Clamp 2 comprises upper clamp frame 6 made of plastic or equivalent, non-electrical conductive material. Clamp frame 6 has internal recess 8 into which first electricity conductor means in the form of upper conductive contact plate 10 is positioned. Contact plate 10, made of an electricity conductive metal, is an integral, elongated member comprising top section 12, jaw member 14 at one end of the top section and dual discs 16 and 18 at the other end of the top section. Electrical conductive wire entry passage 17 is located between discs 16 and 18. Wire insulation crimp member 20 and bare wire crimp member 22 extend from top section 12. Top section 12 of contact plate 10 fits within recess 8 of clamp frame 6, jaw member 14 fits within jaw recess 9 of the clamp frame, and dual plates 16 and 18 fit between clamp frame disc supports 11 and 13.

Clamp 2 also comprises lower clamp frame 24 made of plastic or equivalent, non-electrical conductive material as well. Clamp frame 24 has internal recess 26 into which second electricity conductor means in the form of lower conductive contact plate 28 is positioned. Contact plate 28, made of an electricity conductive metal, is an integral, elongated member comprising bottom section 30, jaw member 32 at one end of the bottom section and dual discs 34 and 36 at the other end of the bottom section. Bottom section 30 of contact plate 28 fits within recess 26 of clamp frame 24, jaw member 32 fits with jaw recess 38 of the clamp frame, and dual discs 34 and 36 fit between clamp frame disc supports 35 and 37.

Figure 3:
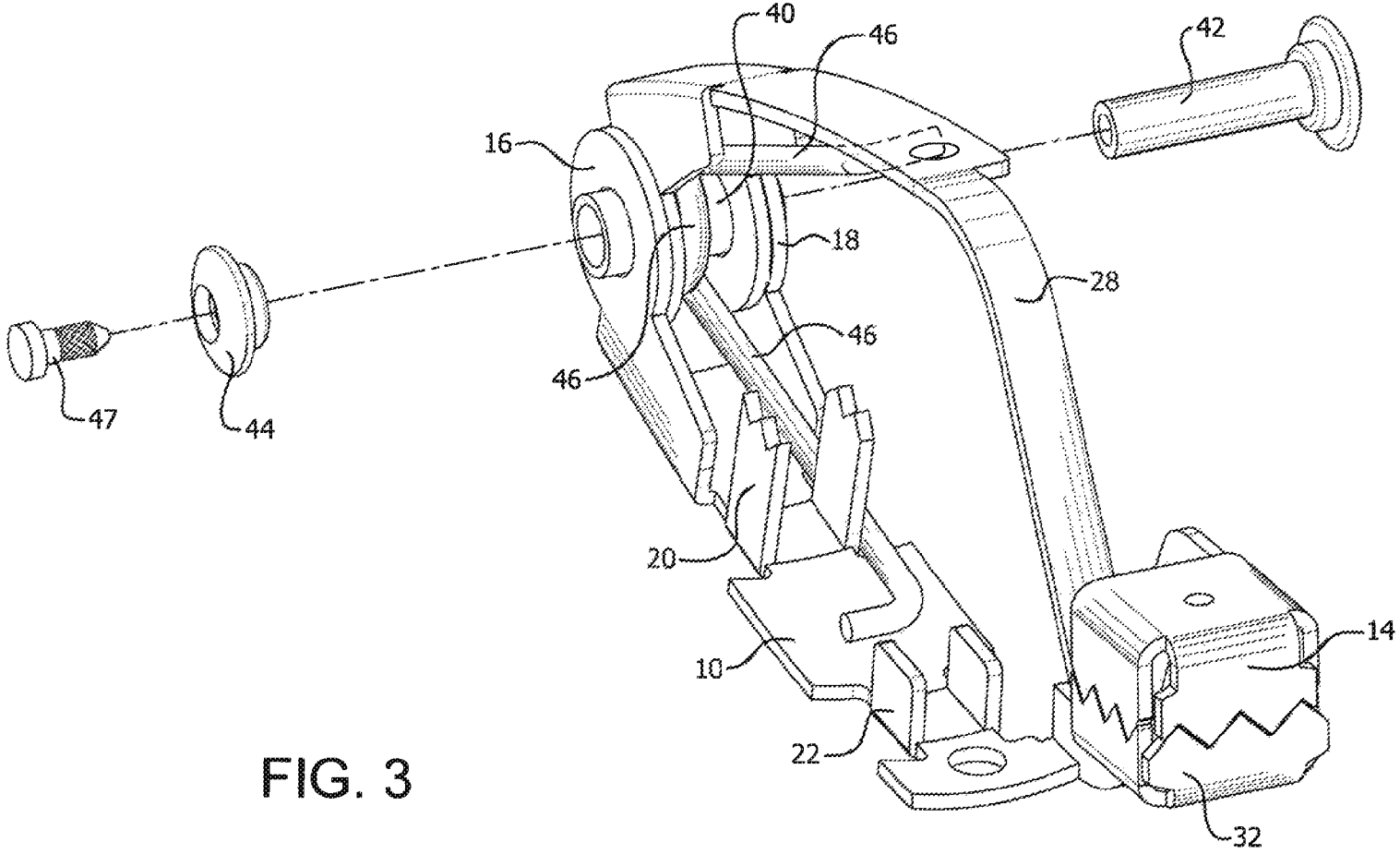
FIG. 3 is a view of the inner components of the jumper clamp of the present invention, partially assembled.

When assembled, upper contact plate 10 mates with lower contact plate 28, with jaw members 14 and 32 in contact with each other, as is best seen in FIG. 3. Electrical conductive sleeve 40 extends between and interconnects dual discs 16 and 18 of contact plate 10 and dual discs 34 and 36 of contact plate 28. The united contact plates 10 and 28 are positioned between and within upper clamp frame 6 and lower clamp frame 24, to form assembled clamp 2. Hinge pin 42 extends through disc supports 11 and 13 of upper clamp frame 6, disc supports 35 and 37 of lower clamp frame 24, and conductive sleeve 40 to secure the components of clamp together and allow pivotable movement of the clamp frames. Cap 44 is fixed over the end of hinge pin 42 by means of attachment pin 47 to secure the hinge pin in place. Both hinge pin 42 and cap 44 are made of non-conductive material.

Figure 4:
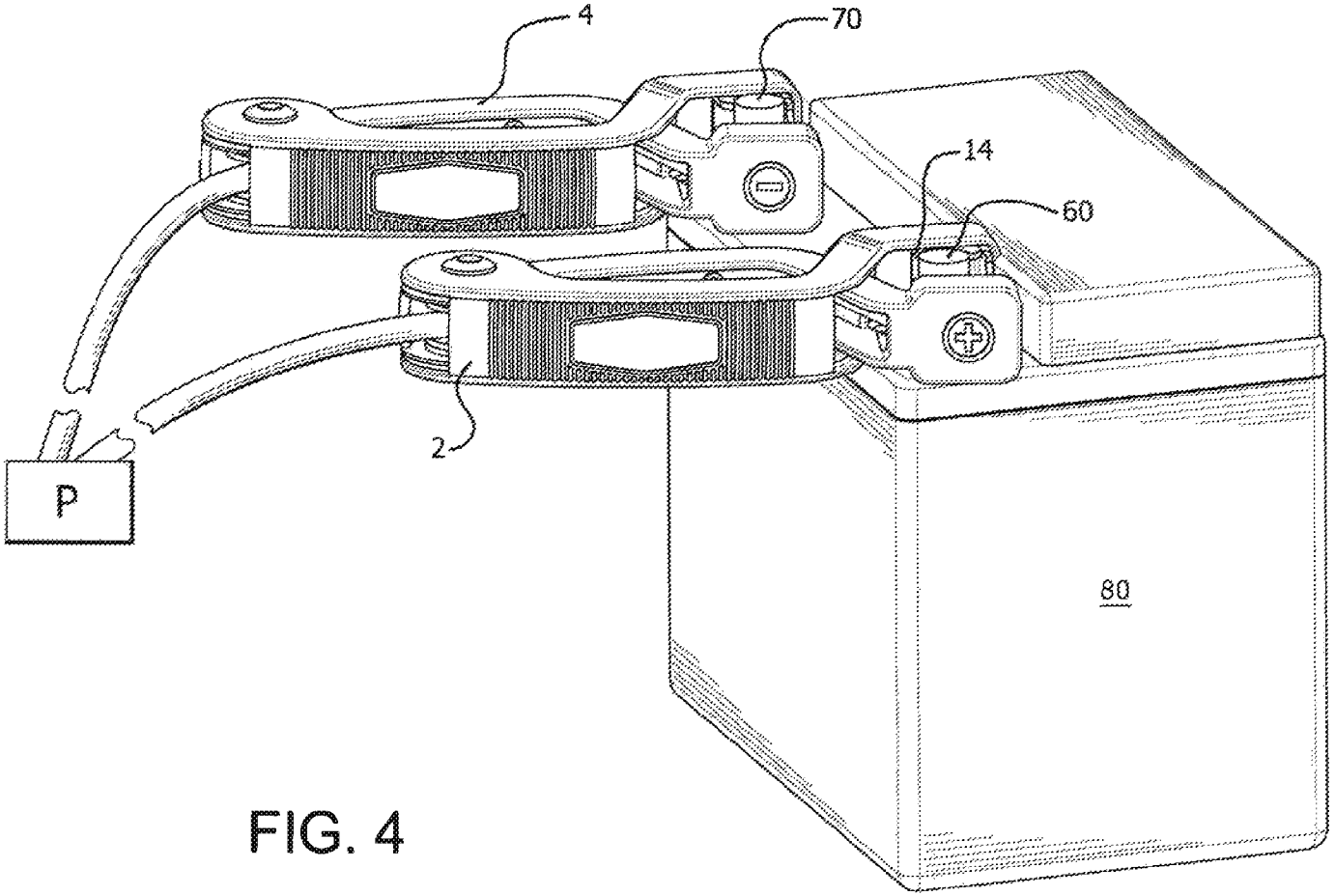
FIG. 4 is a view of the jumper clamps of the jumper clamp system of the present invention in use on an electric battery.

As best seen in FIG. 3, spring 46 extends around conductive sleeve 40 and over and onto bottom section 30 of contact plate 28 and onto top section 12 of contact plate 10. Spring 46 serves to bias upper clamp frame 6 and lower clamp frame 24 in a closed position. In this closed position, jaw members 14 and 32 are in contact and overlay each other. Upon application of manual pressure on upper clamp frame 6 and lower clamp frame 24, the clamp frames separate and clamp 2 is maintained in an open position, with jaw members 14 and 32 located above and in spaced relation to each other, as seen in FIG. 4.

Electrical conductive wire 50 enters clamp 2 by means of passage 17 between disc supports 11 and 13 and discs 16 and 18. Wire 50 is positioned within contact plate 10 and is maintained therein by wire insulation crimp member 20 crimped around its wire insulation. Bare wire 52, stripped of insulation at this area, is positioned within and crimped around bare wire crimped member 22. Wire connection cap 54, secured by screw 56, overlays bare wire 52 within crimped member 22.

In operation, clamps 2 and 4 are depressed, such that jaw members 14 and 32 are in the open position. They are then connected to electrical terminals 60 and 70 of battery 80 or like electrically rechargeable device, as seen in FIG. 4. With regard to clamp 2 (it being understood that clamp 4 operates in the identical manner), power source P provides electricity via conductive wire 50 into clamp 2. Electricity is transmitted through wire 50 to upper contact plate 10 and its jaw member 14. At substantially the same time, the electricity flows from upper contact plate 10, via conductive sleeve 40, to lower contact plate 28 and its jaw member 32. Thus, lower contact plate 28 receives electricity solely from upper contact plate 10. In this manner, electricity from a single electrical power source flows to both jaw members of clamp 2 and, as discussed above, both jaw members of clamp 4 as well. This provides twice the electricity to the device being charged, from a single source.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A jumper clamp for transmitting electricity from an electrical. power source to an electrical terminal, said jumper clamp comprising:

an upper clamp frame;

first electricity conductor means positioned within the upper clamp frame for receiving electricity from an electrical power source and for transmitting electricity to an electrical terminal;

a lower clamp frame;

second electricity conductor means positioned within the lower clamp frame for receiving electricity solely from the first electricity conductor means and for transmitting this electricity to the electrical terminal; and an electrical conductive sleeve means for transmitting electricity between the first electricity conductor means and the second electricity conductor means, whereby upon receiving electricity from the electrical power source, the first electricity conductor means transmits electricity to the second electricity conductor means via the sleeve means.

2. The jumper clamp as in claim 1 wherein the second electricity conductor means comprises an electrical conductive contact plate having an electrical terminal attaching jaw member.

3. The jumper clamp as in claim 1 further comprising an electrical conductive wire extending from the electrical power source to and into the first electricity conductor means for transmitting electricity to said first electricity conductor means.

4. The jumper clamp as in claim 1 further comprising spring means for biasing the upper clamp frame and the lower clamp frame in a closed position, whereby application of pressure on the upper clamp frame and the lower clamp frame positions the frames in an open position, in spaced relation to each other.

5. The jumper clamp as in claim 1 wherein the first electricity conductor means comprises an electrical conductive contact plate having an electrical terminal attaching jaw member.

6. The jumper clamp as in claim 5 wherein the second electricity conductor means comprises an electrical conductive contact plate having an electrical terminal attached jaw member.

7. The jumper clamp as in claim 5 further comprising an electrical conductive wire extending from the electrical power source to and into the contact plate.

8. The jumper clamp as in claim 1 further comprising an electrical conductive wire extending from the electrical power source to and into the first electricity conductor means for transmitting electricity to said first electricity conductor means.

9. A jumper clamp for transmitting electricity from an electrical power source to an electrical terminal, said jumper clamp comprising:

an upper clamp frame;

an electrical conductive contact plate positioned within the upper clamp frame, said contact plate having an electrical terminal attaching jaw member;

a lower clamp frame; and a second electrical conductive contact plate positioned within the lower clamp frame, said second contact plate having an electrical terminal attaching jaw member; and an electrical conductive sleeve positioned between the contact plates, whereby electricity is transmitted only to the contact plate within the upper clamp frame and then solely to the second contact plate within the to lower clamp frame via the conductive sleeve.

10. The jumper clamp as in claim 9 further comprising an electrical conductive wire extending from the electrical power source to and into the contact plate within the upper clamp frame for transmitting electricity to said contact plate.

11. The jumper clamp as in claim 9 further comprising spring means for biasing the upper clamp frame and the lower clamp frame in a closed position, whereby application of pressure on the upper clamp frame and the lower clamp frame maintains the frames in an open position, in spaced relation to each other.

12. The jumper clamp as in claim 11 wherein the jaw member of the second contact plate overlays and is in contact with the jaw member of the first contact plate when the upper clamp frame and lower clamp frame are in the closed position, and the second jaw member is located above and in spaced relation to the first jaw member when the upper clamp frame and the lower clamp frame are in the open position.

13. A jumper clamp system for transmitting electricity from an electrical power source to an electrical terminal, said jumper clamp system comprising:

a first clamp comprising an upper clamp frame having an electrical conductive contact plate positioned within the frame, said contact plate having an electrical terminal attaching jaw member, the clamp further comprising a lower clamp frame having an electrical conductive contact plate positioned within the frame, said contact plate having an electrical terminal attaching jaw member; and a second clamp comprising an upper clamp frame, an electrical conductive contact plate positioned within the upper clamp frame, said contact plate having an electrical terminal attaching jaw member, the second clamp further comprising a lower clamp frame, said lower clamp frame having an electrical conductive second contact plate positioned within the lower clamp frame, said contact plate having an electrical terminal attaching jaw member; and an electrical conductive sleeve positioned between the contact plates within the upper clamp frames of the first and second clamps, whereby electricity is transmitted only to the contact plate within the upper clamp frame of the first clamp and then solely to the contact plate within the upper clamp frame of the second clamp via the conductive sleeve.

14. The jumper clamp system as in claim 13 further comprising an electrical conductive wire extending from the electrical power source to and into the contact plates within the upper clamp frames of both the first and second clamps for transmitting electricity to said contact plates.

15. The jumper clamp system as in claim 13 further comprising spring means for biasing the upper clamp frames and the lower clamp frames of the first and second clamps in closed positions, whereby application of pressure on the upper clamp frames and the lower clamp frames maintains the frames in open positions, in spaced relation to each other.

16. The jumper clamp system as in claim 15 wherein the jaw members of the contact plates of the lower clamp frames of the first and second clamps overlay and are in contact with the jaw members of the contact plates of the upper clamp frames of the first and second clamps when the upper clamp frames and lower clamp frames are in the closed position, and the jaw members of the contact plates of the upper clamp frames of the first and second clamps are located above and in spaced relation to the jaw members of the contact plates of the lower clamp frames when the upper clamp frames and the lower clamp frames are in the open position.

* * * * *